United States Patent [19]

Prather, Jr.

[11] Patent Number: 4,537,402

[45] Date of Patent: Aug. 27, 1985

[54] METHOD OF PLAYING A MOVING SURFACE BALL GAME

[76] Inventor: Herbert W. Prather, Jr., R.D. #3, Station Rd., North East, Pa. 16428

[21] Appl. No.: 196,444

[22] Filed: Oct. 14, 1980

[51] Int. Cl.[3] ..... A63F 7/00

[52] U.S. Cl. ..... 273/116

[58] Field of Search ..... 273/109, 110, 113, 115, 273/116

[56] References Cited

U.S. PATENT DOCUMENTS

| | | | |
|---|---|---|---|
| 1,313,600 | 8/1919 | Johnson | 273/115 |
| 3,236,522 | 2/1966 | Brown | 273/110 |
| 3,502,335 | 3/1970 | Sholin | 273/109 X |
| 3,638,350 | 2/1972 | Wiggen | 273/110 X |
| 3,738,658 | 6/1973 | Smith | 273/109 |

FOREIGN PATENT DOCUMENTS

| | | | |
|---|---|---|---|
| 84283 | 3/1920 | Switzerland | 273/110 |
| 503 | 1/1897 | United Kingdom | 273/115 |

*Primary Examiner*—Richard C. Pinkham
*Assistant Examiner*—Scott L. Brown
*Attorney, Agent, or Firm*—Charles L. Lovercheck; Wayne L. Lovercheck; Dale R. Lovercheck

[57] ABSTRACT

A game device made up of a circular frame with a hole in the center and a handle on each side for holding it and tilting it. A hole is formed in the center of the frame and a net is supported on the bottom of the frame around the hole. The circular track is formed in the frame around the hole and concentric thereto. The player can support the ball in the track and grasp the handles in his hand and tilt the frame from side to side causing the ball to roll around the track. The idea of the game is to roll the ball around the track at the greatest speed without having it fall off or fall into the hole in the center. The movement of the ball can be timed to obtain a score in the game.

1 Claim, 2 Drawing Figures

METHOD OF PLAYING A MOVING SURFACE BALL GAME

REFERENCE TO PRIOR ART

The prior art showing games similar to the invention are shown in the following patents. None of these patents show a game like that disclosed and claimed by applicant.

U.S. Pat. No. 1,566,730; U.S. Pat. No. 3,563,550; U.S. Pat. No. 3,202,426; U.S. Pat. No. 3,671,061; U.S. Pat. No. 3,236,522; U.S. Pat. No. 3,738,658; U.S. Pat. No. 3,471,154; U.S. Pat. No. 3,801,103.

OBJECTS OF THE INVENTION

It is an object of the invention to provide an improved game.

Another object of the invention is to provide a game that is played with a platform having a central opening and a groove concentric to the opening for the ball to roll around the groove and a net below the opening to catch the ball should it fall through.

With the above and other objects in view the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE INVENTION

Figure 1:
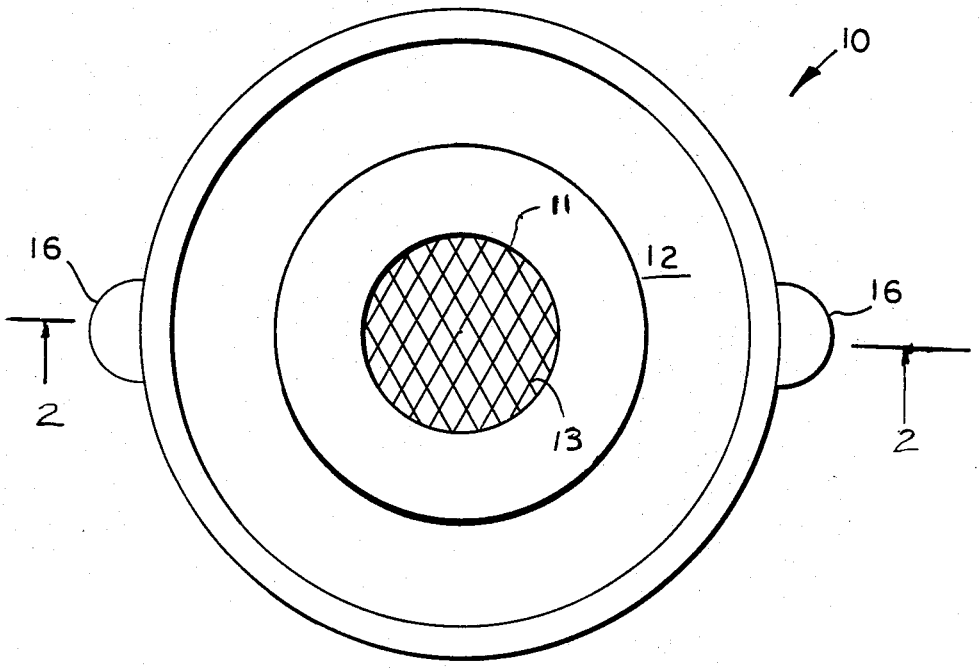
FIG. 1 is a top view of the game according to the invention.
Figure 2:
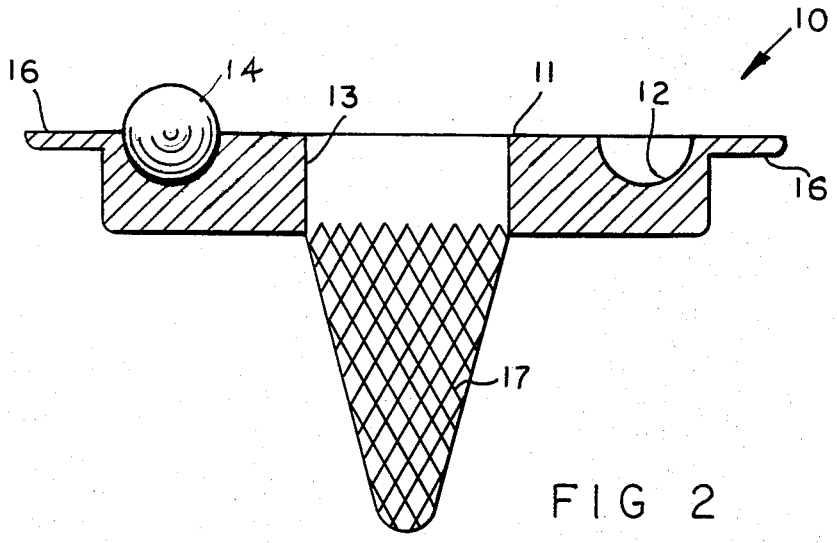
FIG. 2 is a longitudinal cross-section view taken on Line 2—2 of FIG. 1.

Now, with more particular reference to the drawings, the game indicated generally at 10 has circular platform 11 with an opening 13 formed at the center thereof. The platform has a groove 12 formed in it and handle 16 attached to the outer edge thereof. The opening 13 is formed with a radius, for example, at least twice the radius of a tennis ball and the tennis ball 14 is rolled around in the groove. A net 17 is attached to the platform around the inner periphery of the opening 13 by stapling, cement or other suitable means and the net 17 will catch the ball if it rolls out of the groove to the center through the opening 13. Net 17 may be formed of any flexible material cord or the like. It could be a suitable fabric netting or it could be a loosely woven net.

This game can be played by placing a ball in the groove 12 and grasping the handle 16 and tilting the platform from side to side. Thus, if it is tilted too fast the ball will roll out of the groove 12 and fall through central hole 13 into the net 17. As the speed of platform tilting is increased and the speed of the ball is increased the speed of the ball reaches a point that the centrifugal force on the ball will cause the ball to move towards the outside of the groove 12 and finally as the speed is increased further the ball will roll over the outside edge of the groove 12. The object of the game is to roll the ball around the groove 35 times per minute in a platform. If the ball rolls out of the groove the player loses.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. The method of playing a game including: providing an apparatus which comprises, a platform having a round flat planar top upper surface terminating in a flat outer edge, an endless annular groove in the upper surface, handle means attached to each side of the platform, a ball approximately the size of a tennis ball for engaging said groove and being guided along said groove along the upper surface of the platform and to be moved by gravity when the platform is manually tilted, the groove being generally semi-circular in cross section and having a radius slightly larger than the radius of the ball and a depth approximately equal to the radius of said ball, a central cylindrical hole formed in the platform and extending therethrough and terminating at said flat planar surface concentric to said groove and at the center thereof, the hole being at least as large in diameter as the cross-section diameter of the groove, a generally cylindrical net being attached to the platform around the inner periphery of the hole and extending downward below the hole for catching balls that may roll out of the groove to the center when the platform velocity of the ball and rate of tilting is improperly coordinated, grasping the handle means by the hands of an operator at two diametrically opposite positions and tilting the platform rapidly from side to side, thereby causing the ball to roll around the groove at a maximum velocity and to fall off said outer edge if rolled greater than said velocity or to roll into said net under said improper coordination, the rounds of travel of said ball in a given time being counted to determine the score of said player before said ball rolls over the outside edge of said groove or into said net, thereby terminating a turn of said player.

* * * * *